US010612888B2

(12) United States Patent
Toschi

(10) Patent No.: US 10,612,888 B2
(45) Date of Patent: Apr. 7, 2020

(54) ELASTICIZED CARRIER FOR ACCESSORIES OF DIFFERENT SIZES

(71) Applicant: VEGA HOLSTER S.R.L., Calcinaia (PI) (IT)

(72) Inventor: Francesco Toschi, Santa Croce sull'Arno (IT)

( * ) Notice: Subject to any disclaimer, the term of this patent is extended or adjusted under 35 U.S.C. 154(b) by 0 days.

(21) Appl. No.: 16/285,453

(22) Filed: Feb. 26, 2019

(65) Prior Publication Data

US 2019/0353451 A1 Nov. 21, 2019

Related U.S. Application Data

(63) Continuation of application No. 16/167,704, filed on Oct. 23, 2018.

(30) Foreign Application Priority Data

May 21, 2018 (IT) ..... 202018000002589
Nov. 27, 2018 (IT) ..... 202018000003831

(51) Int. Cl.
*F41C 33/04* (2006.01)
*F41C 33/02* (2006.01)

(52) U.S. Cl.
CPC ..... *F41C 33/04* (2013.01); *F41C 33/0227* (2013.01)

(58) Field of Classification Search
CPC ..... B65D 5/4283; B65D 33/02; F41C 33/04; F41C 33/046; F41C 33/0337; A45F 5/02; A45F 5/021
USPC ..... 224/243, 931
See application file for complete search history.

(56) References Cited

U.S. PATENT DOCUMENTS

| | | | | |
|---|---|---|---|---|
| 3,160,307 | A * | 12/1964 | Morrison | B65D 11/1873 220/4.33 |
| 4,248,366 | A * | 2/1981 | Christiansen | A45F 5/00 220/903 |
| D272,773 | S * | 2/1984 | Weissenburger | D3/229 |
| 9,759,536 | B2 * | 9/2017 | Gadams | F42B 39/02 |
| 9,795,210 | B2 | 10/2017 | Evans | |
| 10,306,973 | B2 * | 6/2019 | Evans | A45F 5/02 |
| 2016/0066680 | A1 * | 3/2016 | Hazeltine | A45F 5/021 224/676 |
| 2017/0099934 | A1 | 4/2017 | Evans | |

* cited by examiner

*Primary Examiner* — Adam J Waggenspack
(74) *Attorney, Agent, or Firm* — Themis Law

(57) ABSTRACT

An accessory holder includes a housing, within which an accessory can be replaced during use, and includes a first lateral wall, a second lateral wall, a front anterior wall, a front posterior wall arranged so that the front anterior and posterior walls are interposed between the first and the second lateral wall, and a base closing the housing on the lower side. The lateral and frontal walls and the base are independent elements each made as a single piece, detached from one another and connected to one another by an elastic member.

9 Claims, 8 Drawing Sheets

ELASTICIZED CARRIER FOR ACCESSORIES OF DIFFERENT SIZES

FIELD OF THE INVENTION

The present invention relates to the technical field of accessories for firearms and accessories for use by, and suitable for, law enforcement agencies, soldiers, shooting practitioners, hunters, etc.

In particular, the invention relates to an accessory holder, which is configured to contain accessories or objects in general of different shapes, materials and sizes, for example a loader, a torch or other objects that can be used by law enforcement agencies, soldiers, or shooting practitioners, hunters, sportsmen, etc.

BACKGROUND OF THE INVENTION

There is a thriving market of accessories for firearms, which includes the production of holsters in which to store a weapon safely. The holster provides for fastenings for attachment to a belt or to a platform so that the user can hold the holster to himself with the weapon inserted inside.

Other accessories are then arranged on the belt or on the platform, such as a replacement loader holder, a torch holder, a knife holder, a multi-purpose tool, and/or other objects suitable for the individuals carrying the weapon or for members of law enforcement agencies.

Those accessory holders are not particularly versatile and each can only contain the specific object for which it was made, or, at most, contain smaller similar objects not suitable for that type of accessory holder, thus leaving those objects loose with the risk of a possible loss or fall. For example, a loader holder can only contain the specific loader for which it had been configured and, therefore, cannot contain loaders of different sizes or shapes, in particular loaders of greater sizes, different materials or different objects and with different shapes than the loader.

At present, some solutions have been developed that attempt to adapt to sizes of different objects in order to overcome this limitation.

For example, loader holders have been produced and marketed, which can adapt to loaders of different sizes and/or shapes within a certain limit.

A document describing this type of solution is U.S. Pat. No. 9,795,210, in which the object holder is made of two half-shells joined by elasticized cables.

In this way, the two half-shells, which shape the lateral and front walls and the base, have a certain degree of freedom and can therefore adapt by moving away and approaching each other, thus modifying the size of the housing they delimit.

However, since these are two half-shells, this solution does not provide for a high degree of adaptability. In particular, the two half-shells can move away from each other to increase distance, but the base and side walls remain more or less always in the same position and, therefore, it is difficult to house different objects with different sizes.

Another solution is described in the U.S. publication no. 2017/0099934 still describing an object holder, for example a loader holder, configure to modify the size of the internal housing, thus providing for objects of different sizes.

However, this solution is even more rigid than the previously described solution, because the base of the housing is rigidly connected and forms a continuous body with the two continuous side walls. Then, the whole is closed and supported externally by a more rigid structure.

This solution suffers from the previously discussed technical problems and is even more complex constructively.

SUMMARY OF THE INVENTION

Therefore, the aim of the present invention is to resolve at least in part said technical disadvantages.

In particular, the aim of the present invention is to provide an accessory holder capable of adapting in flexible manner to objects of various sizes, being structurally and constructively simple at the same time.

These and other aims are therefore achieved with the present accessory holder as described hereinafter.

This accessory holder (1) comprising a housing (2), within which the accessory can be replaced in use, said housing being delimited by:

at least a first lateral wall (PL1) and at least a second lateral wall (PL2);

at least a front anterior wall (PFA) and at least front posterior wall (PFP) arranged so that said front anterior and posterior walls are interposed between said first and second lateral walls; and a base (B) for closing said housing on the lower side.

According to the invention, said lateral walls, frontal walls and said base are a single piece, independent elements detached from one another, thus discontinuous, and connected to one another an elastic member, preferably an elastic cable.

In this way, each portion can vary the distance with respect to the other portions with which it is connected. This provides for varying the sizes of the housing 2 in a very flexible manner.

In this manner, all of the above described technical disadvantages are readily resolved.

Therefore, all the aforesaid technical disadvantages are readily resolved.

In particular, all the walls that delimit the housing 2, including the entire bottom wall (B) connected to the four remaining walls are independent, discontinuous and separate from one another. During assembly, they are joined to one another for shaping the housing through elastic means, for example a suitable elastic cable 10 positioned through suitable passing holes obtained in the walls shaping the housing.

In this way, all the walls forming and delimiting the housing can move reciprocally, thus allowing a very flexible variability of the size of the internal housing 2.

The elastic restraint system exerts a restoring force to the original position and, therefore, this causes not only an adaptability of the housing but also a certain force with which the walls, in this event there are at least five different walls, are pushed onto the object arranged in the housing, thus holding it effectively.

For example, the base (B) can now completely translate elastically downwards, increasing the overall volume of the housing and/or the other walls can move away from one another at the same time.

In the event of accessories made of plastic, i.e. with plastic walls, the strength of the rubber bands and the surface of the plastic have together a synergic effect that creates a "grip", therefore a hold, especially useful for operational use when an operator runs, falls, or is in an agitated action where the object must be kept firmly in the object holder.

Additional advantages are also described hereinafter.

BRIEF DESCRIPTION OF THE DRAWINGS

Additional features and advantages of an object holder device (or object holder in other words) according to the invention will become apparent from the following description of preferred embodiments thereof, given only by way of non-limiting examples, with reference to the attached drawings, wherein.

DETAILED DESCRIPTION OF EMBODIMENTS OF THE INVENTION

Figure 1:
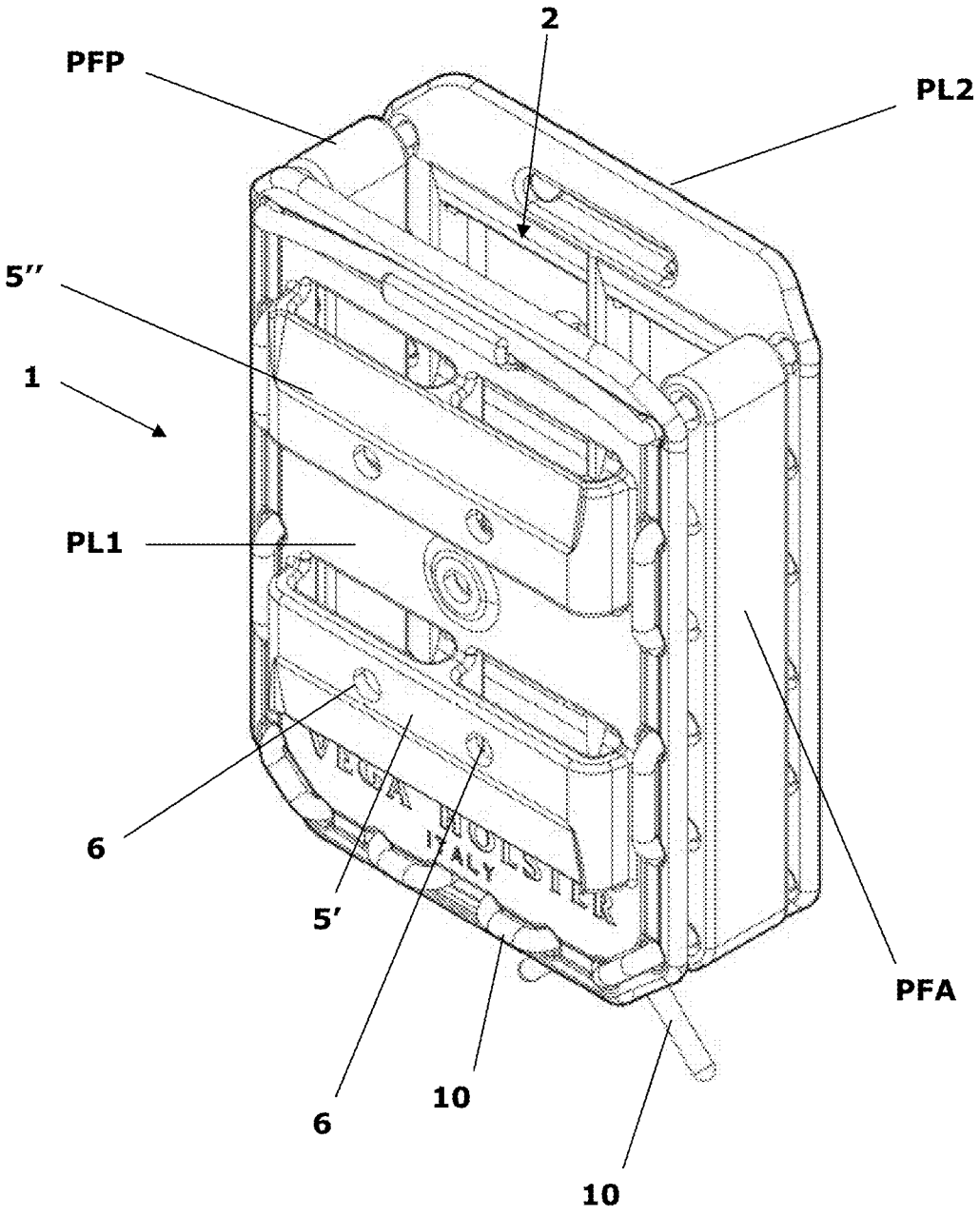
FIG. 1 depicts in axonometric view an accessory holder according to the present invention.

According to the invention, FIG. 1 depicts an accessory holder, which comprises a first lateral wall (PL1) and a second lateral wall (PL2) arranged at a certain distance in front of one another.

One of those walls, as well as both walls, can comprise fastening devices 105 (known in the art) for firmly connecting said accessory holder to a belt or a platform, for example the same belt where the holster is applied.

Figure 1A:
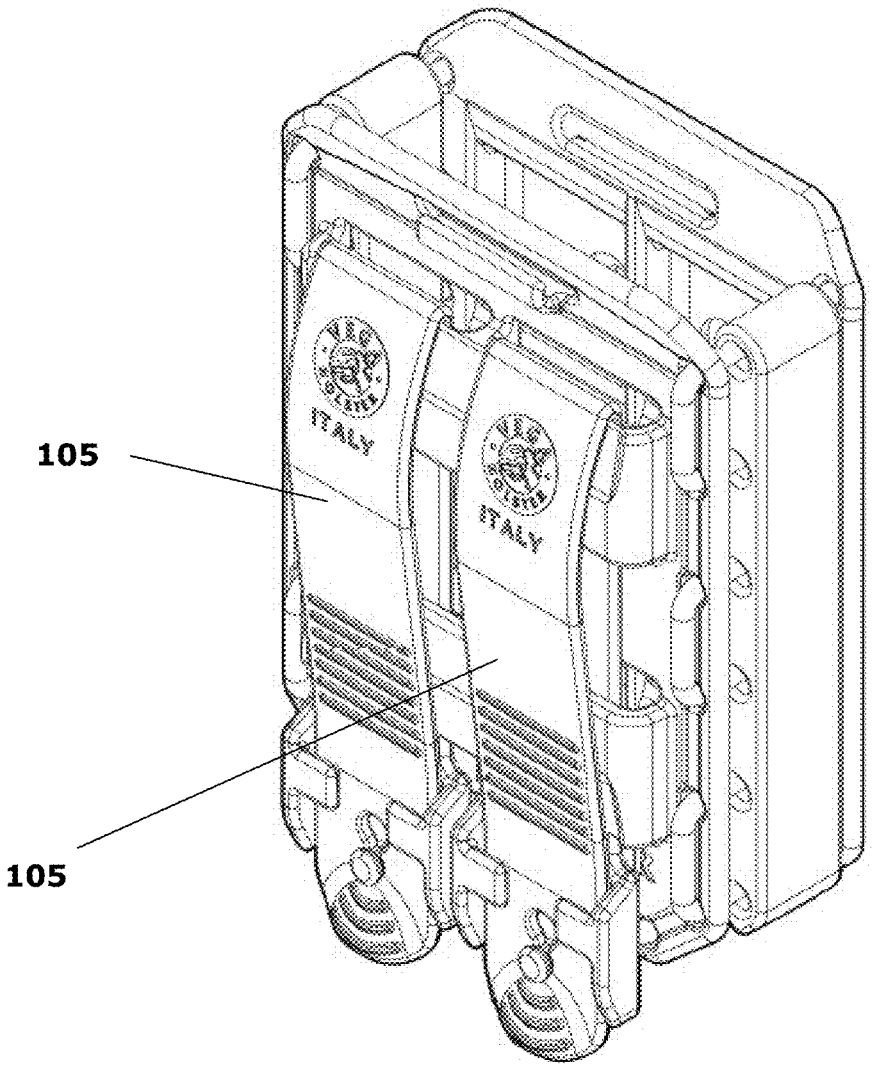
FIG. 1A depicts, also in axonometric view, the accessory holder of FIG. 1 but equipped with clips 105 passing through the loops (5', 5") for attaching it on a belt or a bib.

For example, as depicted in FIG. 1A, clips/plastic loops 105 may be provided, which are coupled to one of said walls and through which the accessory holder can be fastened.

Fastening devices for fastening loader holders, torch holders and the same holster are known in the art and can readily be applied to an accessory holder according to the present invention.

For this purpose, FIG. 1 depicts two loops (5', 5") suitable for the passage of clips 105 and for fastening onto the belt and/or platforms. Each loop has two holes 6 spaced from each other, suitable for fastening various types of loops and/or platforms through screws. The sticks/loops can be applied in the buttonholes for fastening on the belt or platforms.

The aforesaid buttonholes (5', 5") can be both on the first lateral wall (PL1) and on the second lateral wall (PL2) or on one of them only.

In the event that they are on both walls, the advantage is that it is possible to connect on both walls such fastening systems or other standardized accessories known in the prior art (MOLLE military standard). Moreover, the holes on the buttonholes are suitable for fastening other types of loops through screws (for all practical purposes, to increase modularity).

As mentioned, FIG. 1A depicts the clips 105 arranged through the loops (5', 5").

Figure 2:
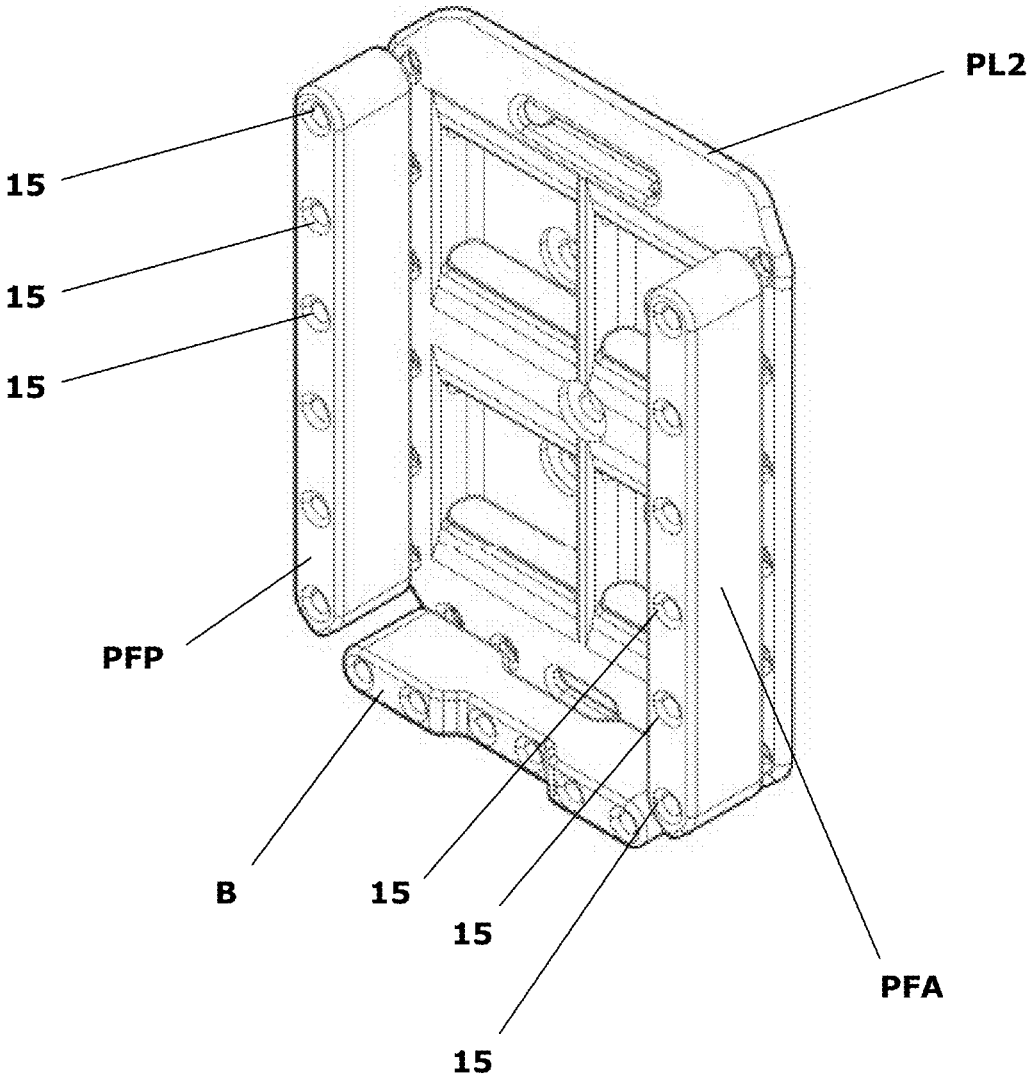
FIG. 2 depicts an accessory holder, in which a lateral wall has been removed in order to see the other elements.
Figure 3:
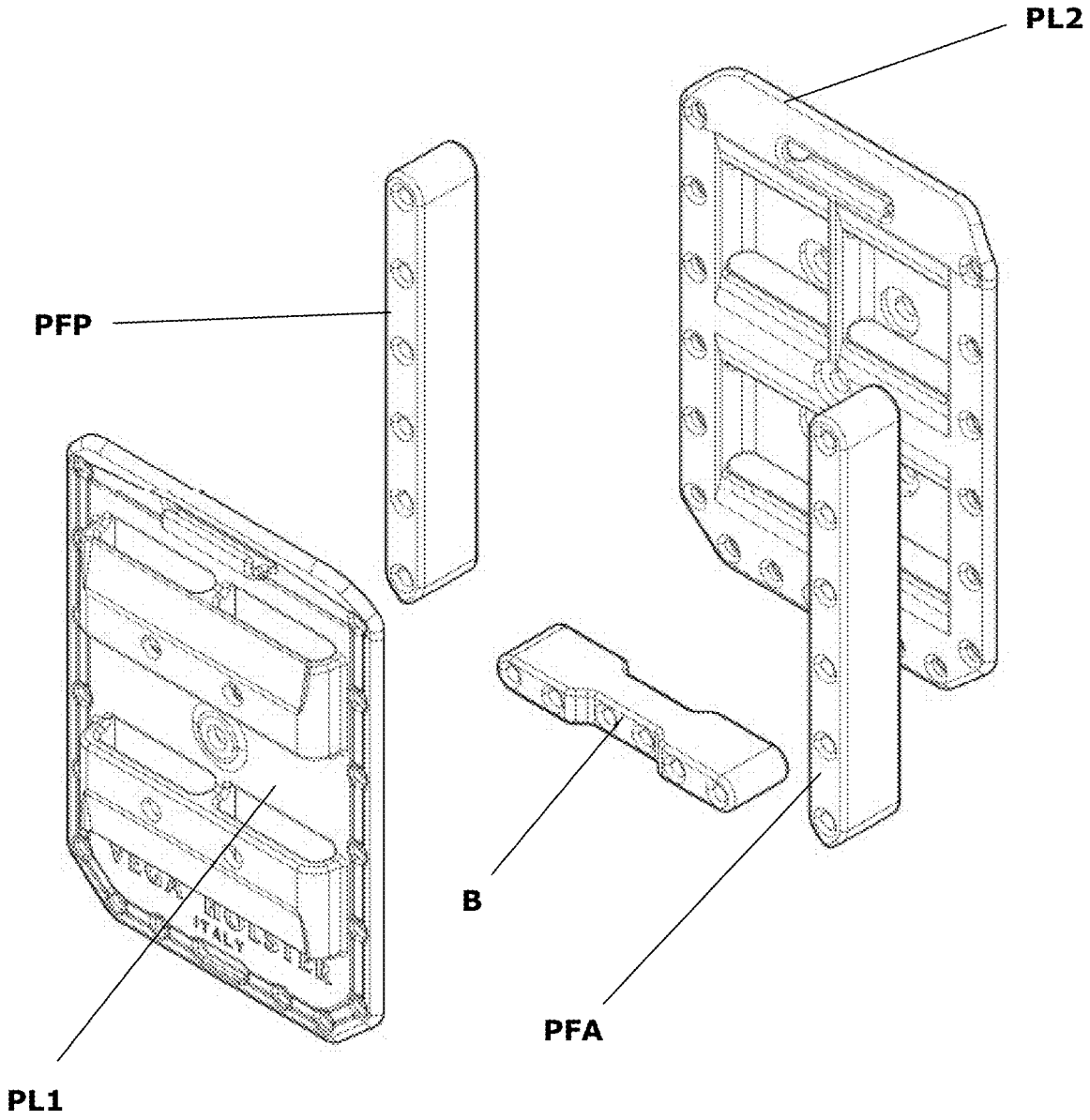
FIG. 3 depicts an exploded view of an accessory holder.

In fact, as depicted in FIG. 2 and even better in FIG. 3, the accessory holder is made with the lateral walls (PL1, PL2), the front anterior and posterior walls (PFA, PFP), and the base (B) which are each made as one-piece, independent and detached from one another, combined to one another, then positioned so as to shape the accessory holder (and then the housing) and fastened to one another through an elasticized cable.

The elasticized cable is depicted in FIG. 1 and is a cable of a predetermined length passing through channels obtained in the various walls forming the above described object.

For example, as depicted in FIG. 2, a succession of holes 15 is provided in the front anterior and posterior walls aligned with corresponding holes obtained along the perimeter of the two lateral walls.

The same occurs with the component forming the base (B) which is in form of a block of predetermined thickness drilled with a succession of holes passing along the width thereof and having holes aligned with the holes obtained in the lateral walls.

This way, a single cable may be inserted through said holes, so as to keep the five walls shaping the accessory holder joined to one another (see for example FIG. 1) and in particular the housing 2.

The cable is elasticized, for example, it may be in the form of an elastic cable of any diameter and extensibility and, therefore, the walls are constrained to one another with a certain degree of freedom.

Depending on the elongation value of the elastic cable being used, it is possible to produce an accessory holder which is more adaptable to different objects and then returns to the initial configuration.

Basically, each of the walls shaping the housing can elastically move away from its fastening position, to return back to the initial position when the force that deformed the housing is released.

This means that, the housing 2, delimited by such five walls, can vary its size in many different ways before returning back in the initial position.

For example, the base B can be lowered with respect to the initial position if, for example, an object is inserted more deeply inside the holder. In the same way, the lateral and/or frontal walls can move away from each other.

In this versatile way, the housing can change its size and, therefore, hold objects of different shapes and sizes.

With reference to the previously described prior art, this solution provides a greater degree of flexibility and the housing changes sizes and shapes more flexibly.

Figure 4:
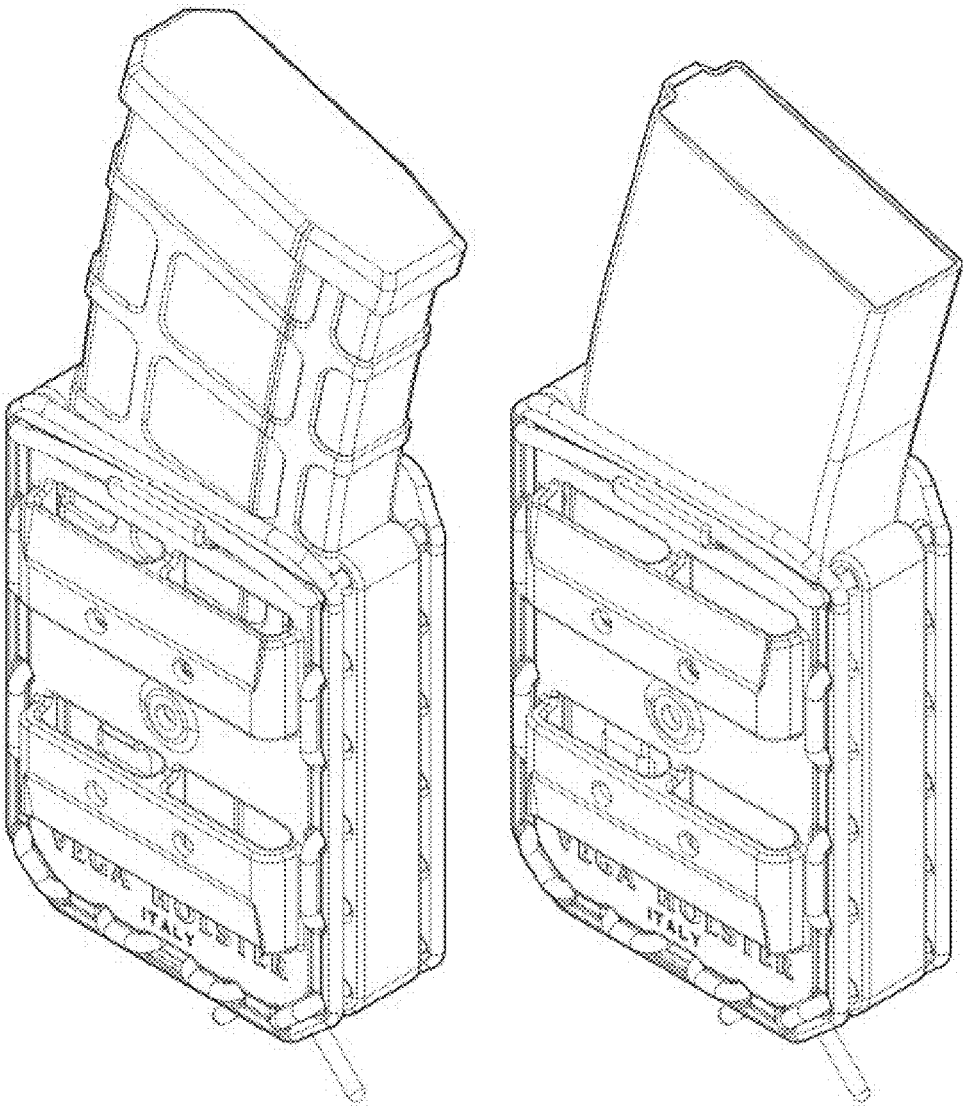
FIG. 4 depicts an example of use with a firearm loader inserted in the accessory holder. In particular, this figure depicts the insertion of two different loaders of different sizes, shapes and material in order to highlight the adaptability of the housing 2.
Figure 5:
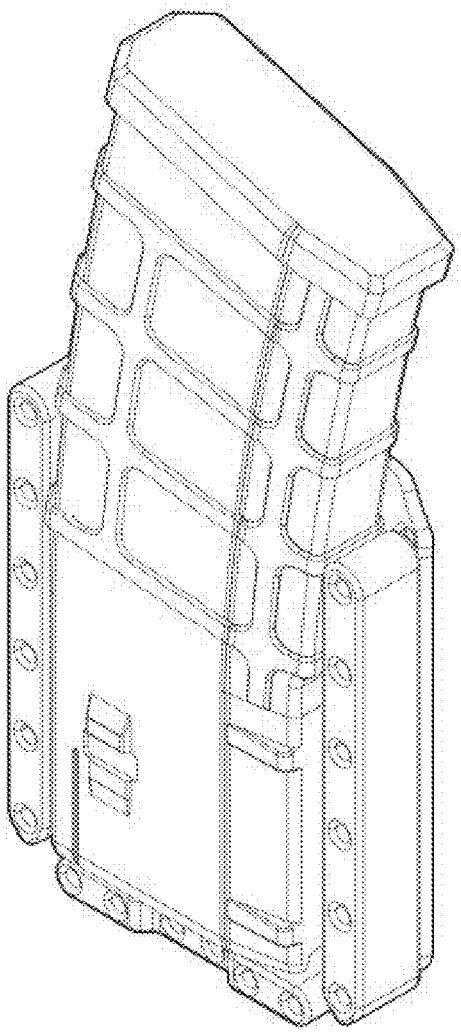
FIG. 5 depicts the loader inserted in the housing with a lateral wall removed, in order to see how the loader is housed inside the housing.

For example, FIG. 4 depicts a case with two loaders of different sizes inserted in the housing. Both loaders can be readily inserted and housed safely in the housing because the size variation of the housing is such that it adapts to different shapes.

A loader can be inserted more deeply in the housing, as the base B can change its position now.

Moreover, different objects can be inserted in the same object holder.

The aforesaid solution is readily adaptable to a modular construction, i.e. more accessory holders can be overlapped on one another in a modular manner, so as to make a loader holder suitable for holding two, three, or any number of loaders (depending on how many modules are overlapped).

Figure 7:
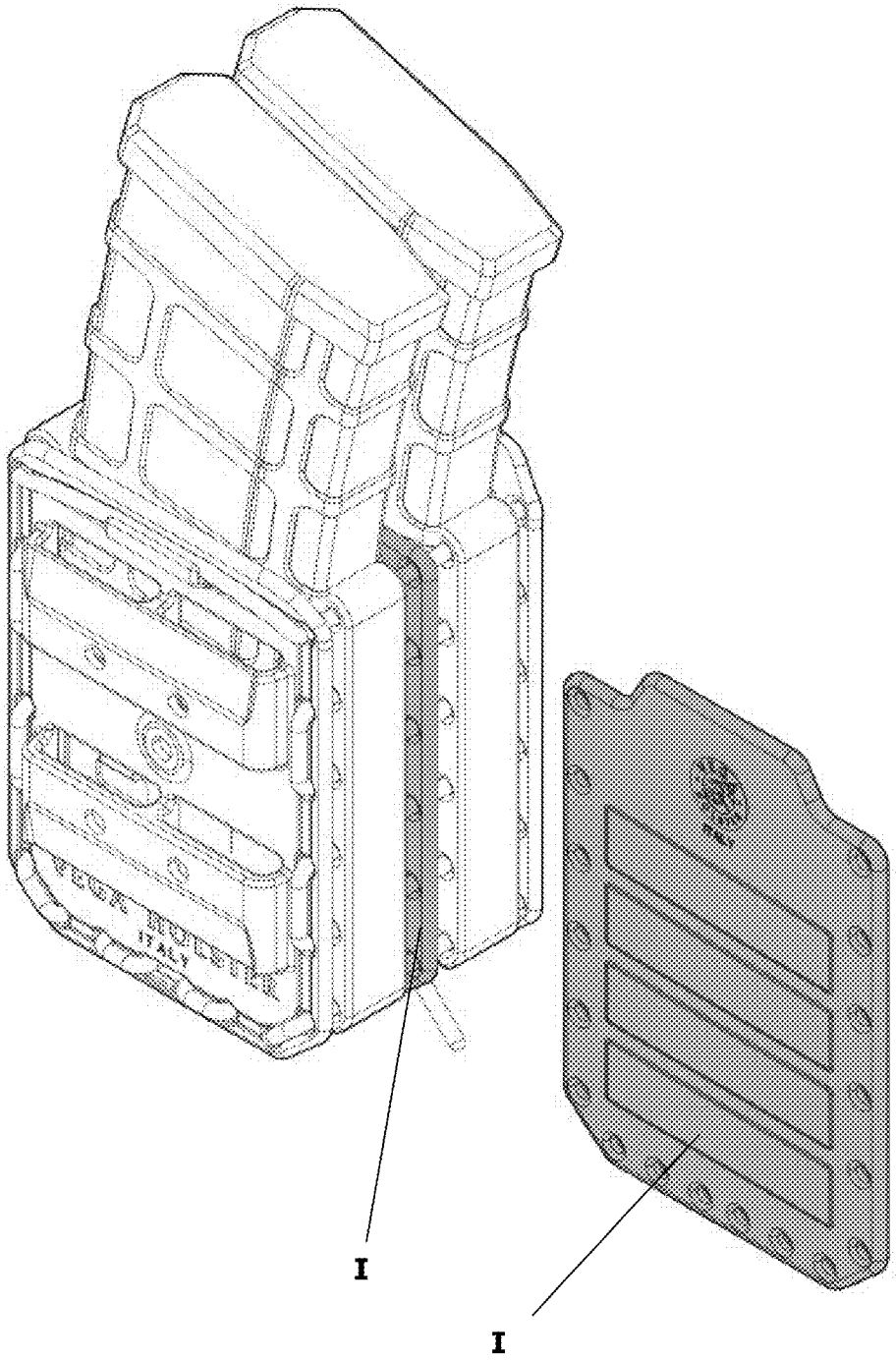
FIG. 7 depicts two overlapping accessory holders coupled to each other.

For example, FIG. 7 depicts a solution with two modular elements overlapping each other and fastened so as to obtain a loader holder for two loaders.

That kind of solution is substantially identical to the first solution that has been described.

Figure 6:
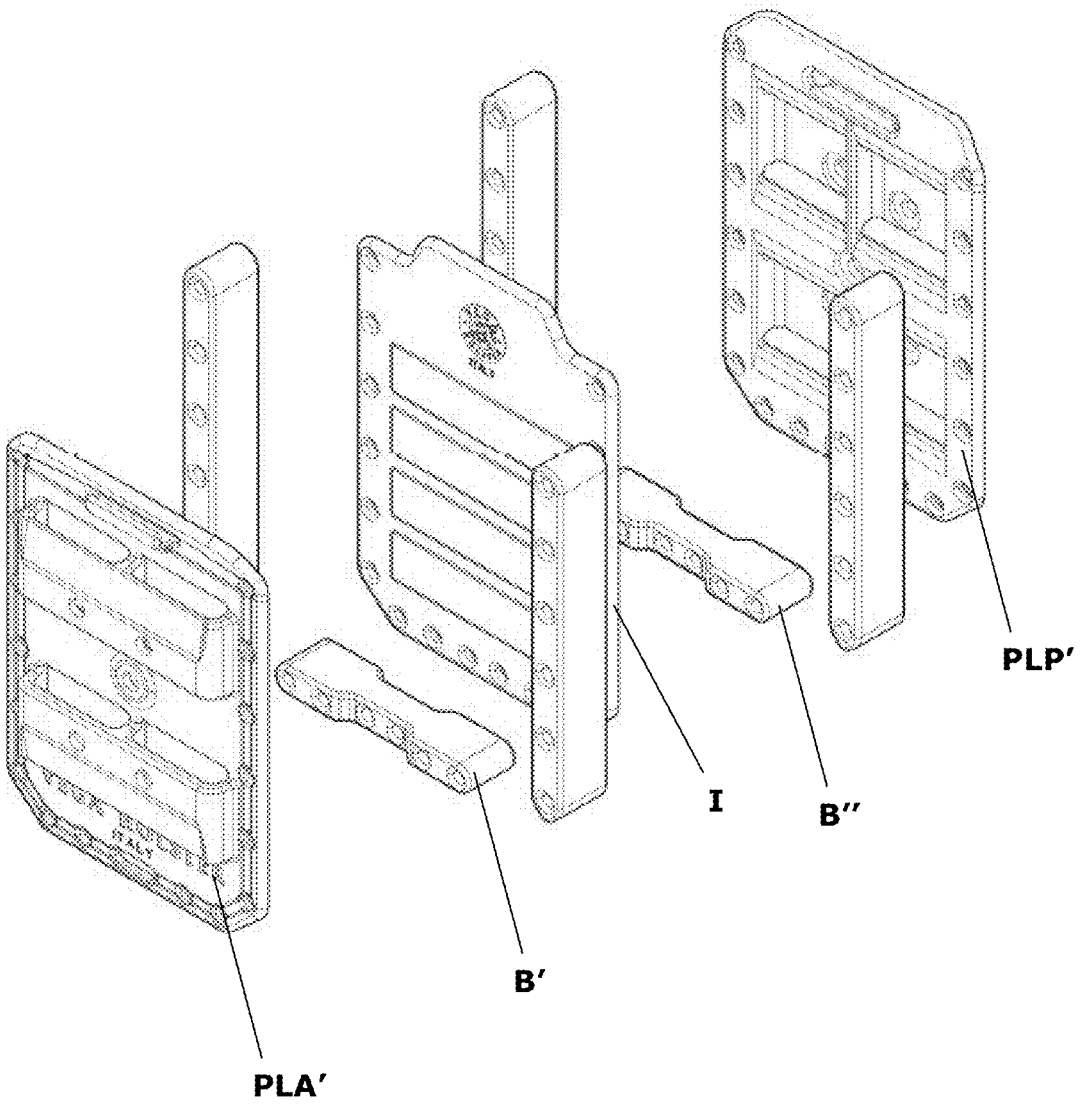
FIG. 6 depicts an exploded view, which highlights how it is possible to couple to one another a plurality of accessory holders in overlapping manner so as to have a substantially modular structure, according to the invention.

The difference is that an intermediate wall or panel (I) is interposed between the two lateral walls (see FIG. 6).

Therefore, a first base (B') is interposed between the intermediate panel and the lateral wall (PLA'). In the same way, a second base (B") is interposed between the intermediate panel (I) and the other lateral wall (PLP'). As depicted in FIG. 6, there are the anterior and posterior walls interposed between the intermediate panel (I) and the two lateral panels (PLA', PLP').

In this way, an accessory holder may be produced, which has two housings for holding two objects different from one another.

This constructive technique provides for replicating the number of required housings.

By repeating this sequence, it is possible to create object holders with any number of housings.

For example, the panel (PLP') of FIG. 6 can be replaced by another intermediate panel (I) repeating the constructive sequence and creating an accessory holder with three or more housings.

Each housing can hold a certain object, even different from the objects arranged in the other housings.

The intermediate panel (I) also has holes passing along the perimeter thereof aligned with the holes of the other components for the passage of the elasticized cable.

In all of the embodiments, more elasticized cables can be used.

In all the described solutions, once the elasticized cable has been passed through the holes, it can be fastened by a knot binding together the two ends of the lace or by inserting a closure necking ring or an equivalent system.

In a more complex but still possible embodiment, the various walls (such as the five walls described in FIG. 3) can be connected to one another with elastic springs instead of the cable.

The parts which form the single walls shaping the invention can be advantageously of a rigid or semirigid material, such as a plastic material and, for example, may be cast in a mold.

As it can be inferred from the enclosed drawings, the base (B) is preferably configured to fully close in the lower side the housing 2, which has only an upper access opening through which the object may be inserted.

The preferred embodiment of the invention has been configured with five walls detached from one another and joined through an elasticized cable. Each wall is a continuous element, for example made of plastic, separate from the remaining walls. Therefore, each wall is in form of a block or a plastic plate that can be produced in independent manner from the other walls and that is assembled by combining with the other walls through the passage of the cable.

As per the exploded view of FIG. 3, it is sufficient to arrange an element in the correct position with respect to the other element and to pass the cable through the provided holes.

However, more than five walls may be provided, which are connected to one another through an elasticized element, in order to have a housing open above and fully obstructed on the base and sides thereof.

The invention claimed is:

1. An accessory holder comprising:

a housing adapted to replaceably receive an accessory, said housing comprising:

at least one first lateral wall and at least one second lateral wall;

at least one front anterior wall and at least one front posterior wall;

at least one base configured to close a lower side of the housing, wherein the first and second lateral walls, the front anterior and posterior walls, and the base are single piece, rigid independent elements detached from one another and connected to one another with an elastic member, the first and second lateral walls, the front anterior and posterior walls, and the base being movable away from one another after assembly so as to provide an expandable accessory holder; and fastening devices adapted to connect the accessory holder to a belt or a platform of a user.

2. The accessory holder, as per claim 1, wherein the front anterior wall and the front posterior wall are arranged so as to be interposed between the first lateral wall and the second lateral wall, and wherein the base is also interposed between the first lateral wall and the second lateral wall.

3. The accessory holder, as per claim 2, wherein the first lateral wall, the second lateral wall, the front posterior wall, the front anterior wall, and the base have a plurality of passing holes for passage of the elastic member, wherein the first lateral wall, the second lateral wall, and the base have rectangular cross-sections, wherein side walls the first lateral wall, the second lateral wall, and the base abut against the front posterior wall and the front anterior wall, and wherein the passing holes in the first lateral wall, the second lateral wall, the front posterior wall, the front anterior wall, and the base extend across an entire depth and between parallel walls thereof.

4. The accessory holder, as per claim 1, wherein the elastic member is configured as at least one elastic cable, which is passed so as to keep the first lateral wall, the second lateral wall, the front posterior wall, the front anterior wall, and the base attached to each other, thus shaping the housing.

5. The accessory holder, as per claim 1, further comprising an intermediate wall configured to be interposed between the first and the second lateral walls so as to create two housings overlapping to each other.

6. The accessory holder, as per claim 5, wherein, when the intermediate wall is provided, a first front anterior and a first front posterior walls and a first base are interposed between a side of the intermediate wall and the first lateral wall, and in a mirror-like manner on an opposite side of the intermediate wall, a second front anterior and a second front posterior wall and a second base are interposed between the intermediate wall and the second lateral wall.

7. The accessory holder, as claim 5, wherein one or both of the first and the second lateral walls are equipped with a fastening system adapted to fasten the accessory holder to a belt or a plate.

8. The accessory holder, as per claim 1, wherein the base fully closes a lower part of the housing and is a single piece component interposed between the first lateral wall, the second lateral wall, front posterior wall, and the front anterior wall.

9. The accessory holder, as per claim 1, wherein the accessory holder is configured to be one of:

a loader holder;

a torch holder; or a knife or multi-purpose tool holder.

* * * * *